US012415589B2

(12) United States Patent
Bieker et al.

(10) Patent No.: US 12,415,589 B2
(45) Date of Patent: Sep. 16, 2025

(54) BOAT WITH INDEPENDENTLY-CONTROLLED, TWIN REAR STEERING, STOWABLE HYDROFOILS

(71) Applicants: Paul Bieker, Anacortes, WA (US); Renardo Baird, Alameda, CA (US); Sampriti Bhattacharyya, Alameda, CA (US)

(72) Inventors: Paul Bieker, Anacortes, WA (US); Renardo Baird, Alameda, CA (US); Sampriti Bhattacharyya, Alameda, CA (US)

( * ) Notice: Subject to any disclaimer, the term of this patent is extended or adjusted under 35 U.S.C. 154(b) by 474 days.

(21) Appl. No.: 18/074,429

(22) Filed: Dec. 2, 2022

(65) Prior Publication Data

US 2024/0166304 A1 May 23, 2024

Related U.S. Application Data

(60) Provisional application No. 63/426,293, filed on Nov. 17, 2022, provisional application No. 63/426,302, filed on Nov. 17, 2022, provisional application No. 63/426,280, filed on Nov. 17, 2022.

(51) Int. Cl.

| | |
|---|---|
| ***B63B 1/28*** | (2006.01) |
| ***B63B 1/24*** | (2020.01) |
| ***B63B 1/26*** | (2006.01) |
| ***B63H 21/17*** | (2006.01) |

(52) U.S. Cl.

CPC ..... *B63B 1/283* (2013.01); *B63B 1/242* (2013.01); *B63B 1/246* (2013.01); *B63B 1/26* (2013.01); *B63B 1/285* (2013.01); *B63H 21/17* (2013.01)

(58) Field of Classification Search

CPC ..... B63B 1/283; B63B 1/242; B63B 1/246; B63B 1/26; B63B 1/285; B63H 21/17

See application file for complete search history.

(56) References Cited

U.S. PATENT DOCUMENTS

| | | | |
|---|---|---|---|
| 1,665,149 | A | 4/1928 | Van Wienen |
| 2,601,836 | A | 7/1952 | Crewe |
| 3,150,626 | A | 9/1964 | Irgens |
| 3,241,511 | A | 3/1966 | Drtina |

(Continued)

FOREIGN PATENT DOCUMENTS

| | | | | |
|---|---|---|---|---|
| CA | 2944976 C | * | 6/2023 | ..... B63B 1/26 |
| JP | 3172459 U | | 12/2011 | |

(Continued)

*Primary Examiner* — Stephen P Avila

(74) *Attorney, Agent, or Firm* — Boris Leschinsky

(57) ABSTRACT

A fully electric hydrofoil boat comprises an elongated hull, a front canard hydrofoil supported by a front support system configured to raise or lower thereof, and a pair of independently-controlled port and starboard rear stowable hydrofoils supported by their respective rear support systems, configured to raise or lower the rear hydrofoils to a selected depth or tilt them out of the water when docking or transporting the boat on a trailer. The hull has a cut-out section in the front portion sized to fit the front canard hydrofoil out of the water if desired. The boat may operate energy-efficiently in a hydrofoil flight mode at high speeds or in a displacement mode at slow speeds when the hydrofoils are in their raised positions.

17 Claims, 13 Drawing Sheets

(56) References Cited

U.S. PATENT DOCUMENTS

| | | | |
|---|---|---|---|
| 5,134,954 | A | 8/1992 | Barry et al. |
| 6,782,839 | B1 | 8/2004 | Nozaki |
| 8,893,640 | B2 | 11/2014 | Stephinson et al. |
| 10,532,793 | B2 | 1/2020 | Lagarrigue et al. |
| 2022/0266949 | A1 | 8/2022 | Percy et al. |

FOREIGN PATENT DOCUMENTS

| | | | | |
|---|---|---|---|---|
| KR | 10-2017-0060741 | A | 6/2017 | |
| WO | WO-2016009409 | A1 * | 1/2016 | ..... B63B 1/246 |

* cited by examiner

BOAT WITH INDEPENDENTLY-CONTROLLED, TWIN REAR STEERING, STOWABLE HYDROFOILS

CROSS-REFERENCE DATA

This patent application claims a priority date benefit from the following US Provisional Patent Applications, all filed on 17 Nov. 2022: Application No. 63/426,280 entitled "Boat with independently controlled, twin rear steering, stowable hydrofoils"; Application No. 63/426,293 entitled "Hull shape designed for stowing and protecting canard hydrofoil"; and Application No. 63/426,302 entitled "Inverted Bow Hydrofoil Boat," all of which are incorporated herein by reference in their respective entireties.

BACKGROUND

Without limiting the scope of the invention, its background is described in connection with hydrofoil boats. More particularly, the invention describes a boat with independently-controlled, twin rear steering, stowable hydrofoils.

With as much as forty-six percent of the world's population living in coastal cities, providing affordable and environmentally-friendly transportation on water is an important objective. It is estimated that a traditional boat with a combustion engine is about 15 times more expensive to operate than a car. That makes adaptation of boating for transportation and recreational boating unaffordable for most people, A dramatic reduction in operating costs is needed to reverse that trend.

Increasing the efficiency of moving through the water is a critical factor in reducing energy consumption and operating costs of a watercraft. The idea of a hydrofoil boat was proposed back in the 1950s—with the advantage of lifting the hull of the boat above the water line once a cruising speed is reached, thereby significantly reducing the drag of the hull against the water. Another significant advantage is the elimination of seasickness as the watercraft is not affected by sea waves during its motion above the water line. Despite these attractive advantages, the use of a hydrofoil concept has been sparse, which may be explained by a number of factors. One of these factors is the difficulty of transporting such a boat and launching it from a trailer due to its protruding foils. Another difficulty is the necessity to reach a fairly high speed to lift the boat off the water. A further difficulty is an inability to operate in shallow waters. Finally, it is not easy to control and steer such a boat as compared to a traditional boat, which is familiar and intuitive for many users. The need exists, therefore, for a novel design of a hydrofoil boat that reduces these disadvantages and makes the use of such a boat more convenient, affordable, and intuitive for the general public.

A further disadvantage of a hydrofoil boat of the prior art is the continuous exposure of the foils to the surrounding water, causing fouling, a gradual propagation of marine growth on the surface of the foils. Marine growth comes in different forms, broadly divided into hard (generally animal, such as muscles and barnacles) and soft (seaweeds and kelps). Hard growth is generally thinner but rougher (increase in drag coefficient) than soft growth. In either case, marine growth causes a change in the geometry of the foils, making it significantly less effective and requiring frequent and expensive cleaning operations. The need exists, therefore, for a hydrofoil boat design that reduces fouling and the presence of marine growth and preserves the geometry of the foils to maintain their effective performance.

SUMMARY

Accordingly, it is an object of the present invention to overcome these and other drawbacks of the prior art by providing a novel hydrofoil boat capable of operating in shallow waters.

It is another object of the present invention to provide a novel hydrofoil boat configured for transporting on a conventional trailer and launching from conventional boat ramps.

It is a further object of the present invention to provide a novel hydrofoil boat with reduced fouling or marine growth present on its foils.

It is yet a further objective of the present invention to provide a novel hydrofoil boat with a steering system similar to that of conventional boats so as to make it familiar, intuitive, and easy to use for users skilled in operating and steering a conventional boat.

The novel hydrofoil boat of the invention has an elongated hull defining a front portion and a rear portion of the boat. The front portion of the hull may feature an inverted bow, which may be helpful in maintaining better stability of the boat when encountering a water wave. A front canard hydrofoil may be mounted on a front support system positioned in the front portion of the hull. The front support system may be configured to raise or lower the front canard foil between a front stowed position and a front operating position. The hull of the boat may have a cut-out section in the front portion thereof sized to be sufficiently large and raised above the water line so as to accept the front canard hydrofoil therein when the front hydrofoil is lifted in the front stowed position. In this case, the front canard hydrofoil may be stowed above the water line and, therefore, may not be exposed to marine growth when the boat is docked.

The boat of the invention may also include a pair of independently-controlled first rear hydrofoil and second rear hydrofoil, each of the first and second rear hydrofoils may be mounted on a respective first rear support system and a second rear support system in the rear portion of the hull. Each of the first and the second rear hydrofoils may be equipped with a respective and independently-controlled first and second motor-driven propeller configured to advance the boat forward when operated by electrical motors, making the entire boat electrically operated.

Each of the first and the second rear support systems of the boat may be further configured to:

- independently raise or lower the respective first and second rear hydrofoils between a raised position and a lowered position,
- independently rotate the respective first and second hydrofoils around their respective first and second vertical axes to facilitate steering of the hydrofoil boat, and
- independently tilt the respective first and second rear hydrofoils out of the water when the first and second rear hydrofoils are in the raised position, making it possible to position all hydrofoils of the boat above the water line while docked so as to minimize the fouling of the hydrofoils.

Each of the rear support systems may include a first and second strut configured to support the respective first and second rear hydrofoils. Each strut may be made to have an elongated cross-sectional shape. In this case, rotating each of the first and second rear hydrofoils around their respective vertical axes would cause the first and second struts to act as rudders, further facilitating steering control of the boat.

The boat may be operated in one of two modes while moving through the water:

- a hydrofoil flight mode when the hydrofoils are deployed to their operational depth and the boat is moving at or above a speed sufficient to lift the hull above the water line, and
- a water displacement mode at slow speed, when the front hydrofoil is stowed, and the rear hydrofoils are deployed at a minimal depth to submerge propellers into the water—the boat is operated in this case similarly to a conventional displacement boat.

The above-described configuration addresses critical deficiencies of the prior art hydrofoil boats in that it allows convenient storage and transport of the boat using trailers (with the hydrofoils in their stowed positions), operation in shallow water, intuitive control similar to conventional twin-engine boats, and reduced fouling of the hydrofoils which may be positioned out of the water when the boat is docked and not moving.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF PREFERRED EMBODIMENTS OF THE INVENTION

Figure 1:
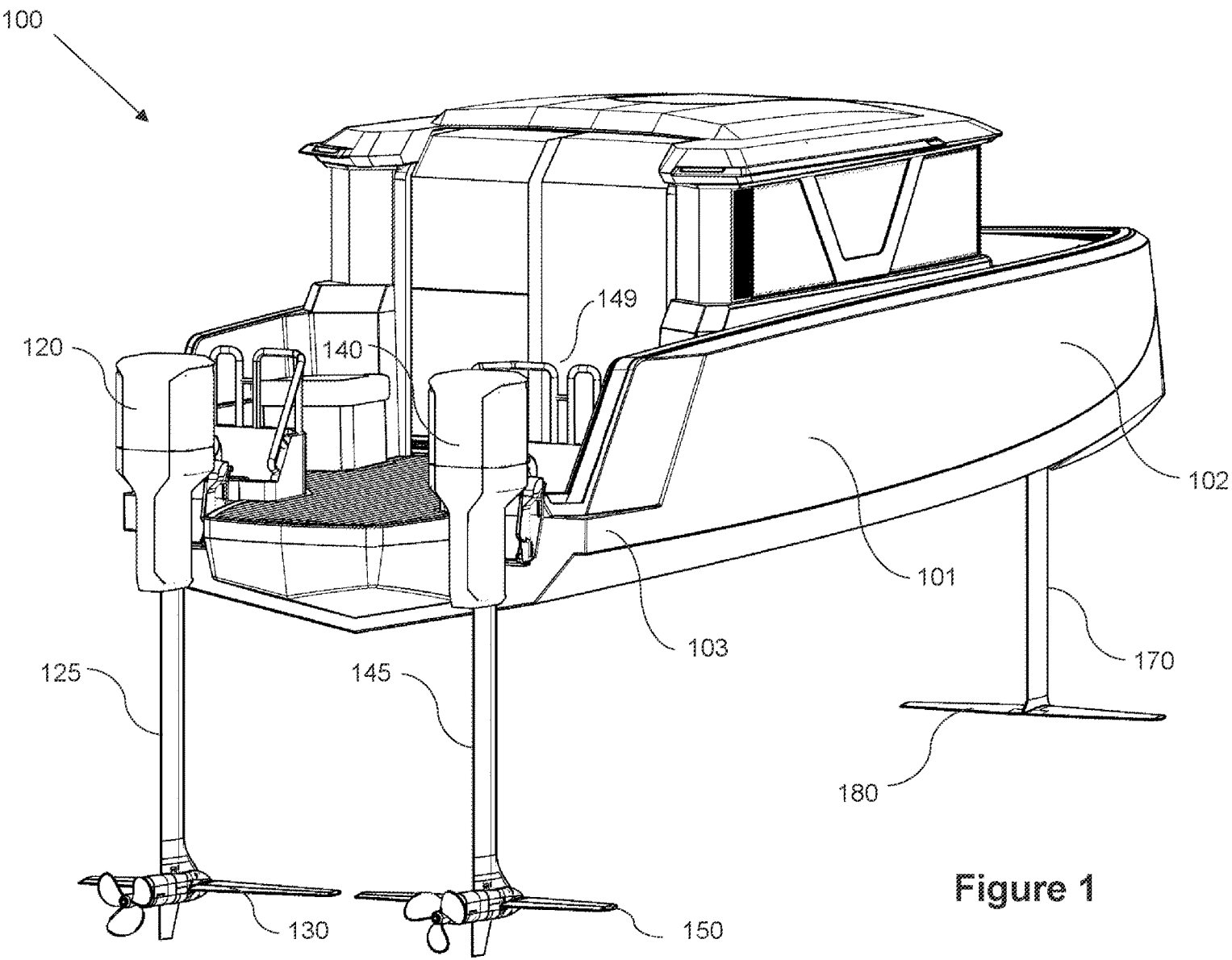
FIG. 1 is a perspective view of the boat of the invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIG. 1 shows a general perspective view of the boat 100 of the present invention. The boat comprises an elongated hull 101 having a front portion 102 and a rear portion 103, a front canard hydrofoil 180 supported by a front support system 170, a first rear hydrofoil 130 mounted on a first rear strut 125 and supported by a first rear support system 120, and a second rear hydrofoil 150 mounted on a second rear strut 145 and supported by a second rear support system 140. The elongated hull 101 defines a longitudinal axis of symmetry, with major components positioned on or along thereof. For example, the front canard hydrofoil 180 may be located along the longitudinal axis of symmetry of the boat. At the same time, two rear hydrofoils, 130 and 150, may be located side-by-side and also symmetrically with regard to the longitudinal axis of symmetry.

Present in the design but not shown in FIG. 1 is the electrical control system with associated sensors and powerlines connected to various electrical motors and actuators, as well as a set of batteries required to power up the entire hydrofoil boat of the invention. Positioning of the batteries may be accomplished to balance the weight of the boat, as can be appreciated by those skilled in the art.

Figure 2:
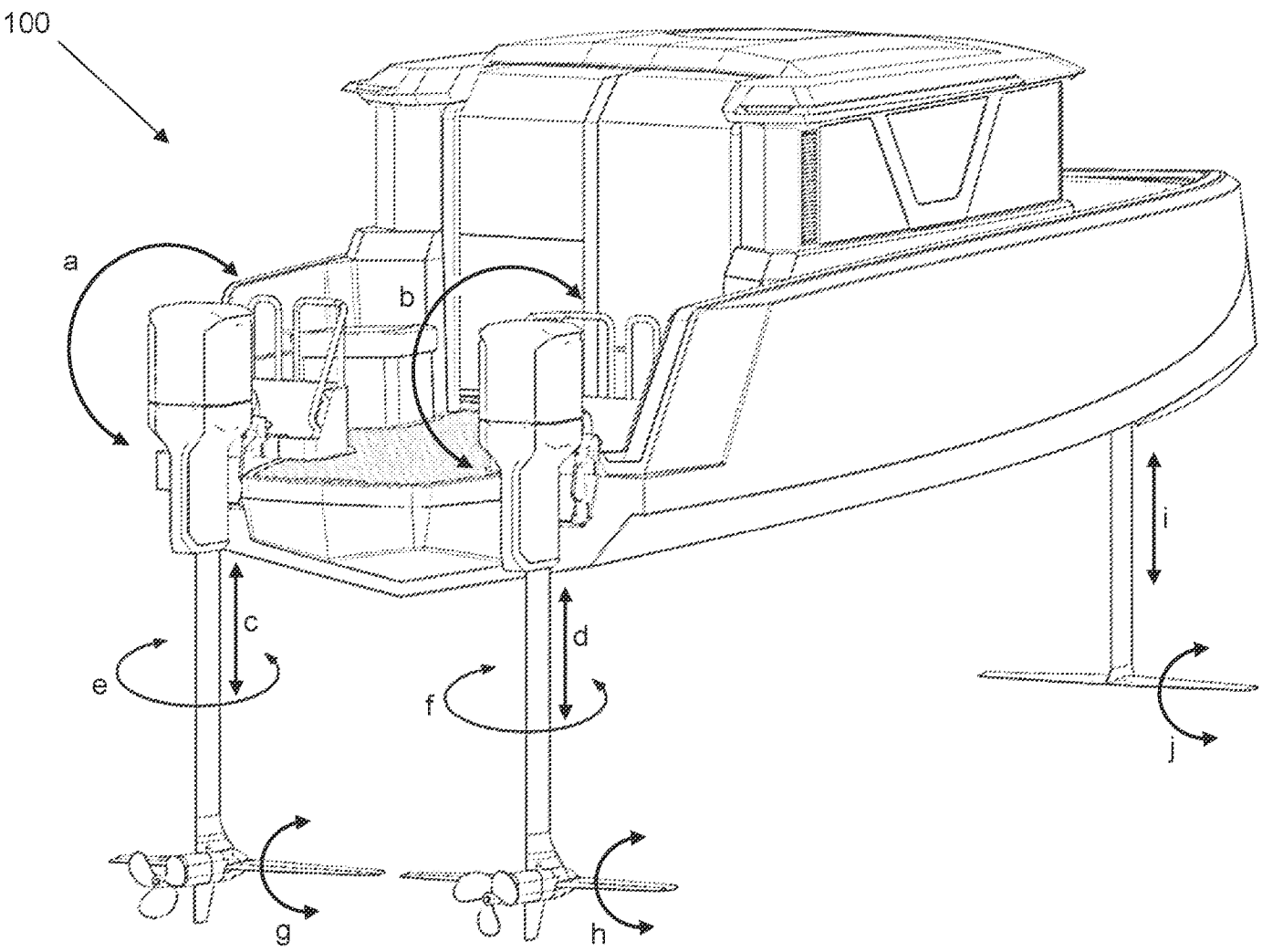
FIG. 2 is a diagram perspective view of various controls for the boat of the invention.

One of the objectives of the novel boat design is to provide a sophisticated control system, which, at the same time, would be familiar to users of conventional boats and, therefore, would be intuitive and easy to use. To that end, the boat provides for various control elements as listed in greater detail below and illustrated in FIG. 2:

- the first rear hydrofoil 130 (which may also be referred to as a port aft hydrofoil) and the second rear hydrofoil 150 (which may also be referred to as a starboard aft hydrofoil) may be raised and lowered by their respective rear support systems 120 and 140 along the vertical arrows "c" and "d" in FIG. 2—as independently controlled via the control system of the boat. The extent of the raising and lowering of the rear hydrofoils 130 and 150 between their respective raised position and lowered position may be sufficient to provide operation of the boat in various water depths, including shallow depths when both rear hydrofoils 130 and 150 (along with the front canard hydrofoil 180) are in their raised positions;
- either of the rear hydrofoils 130 and 150 may be independently rotated left and right around their respective vertical axes, as shown by arrows "e" and "f" in FIG. 2, to provide for yaw control. Independent control of this rotation may allow the motor-driven propellers of each rear hydrofoil to not operate with their thrust vectors in parallel with each other—so as to perform various docking and other boat maneuvers similar to a conventional twin-outboard boat. For example, pointing both propellers away from each other allows performing a standard twin-outboard docking maneuver (with a variable position of the center-of-pressure point), which is not common in other hydrofoil boats of the prior art. In addition, combining the yaw control with the raising or lowering of the rear or the front hydrofoils may allow for an extra degree of freedom, making it even more advantageous during docking maneuvers;

both rear hydrofoils may be tilted to be out of the water when the boat is docked and when the rear hydrofoils are in the raised position, as seen by arrows "a" and "b" in FIG. 2, allowing the hydrofoils 130 and 150 to stay out of the water to minimize marine growth thereon;

each rear hydrofoil 130 and 150 may have at least one flap which may be operated to tilt it up or down, as shown by arrows "g" and "h" in FIG. 2—providing further control options when the boat is operated in a hydrofoil flight mode;

the front canard hydrofoil 180 may be also raised or lowered by the front support system, as shown by the arrow "I" in FIG. 2, so as to move the front hydrofoil between the front stowed position and the front operating position; and, finally the front canard hydrofoil may have at least one flap, which may be operated to tilt up or down, as seen by the arrow "j" in FIG. 2, so as to further control the performance of the front canard hydrofoil in flight.

Figure 3:
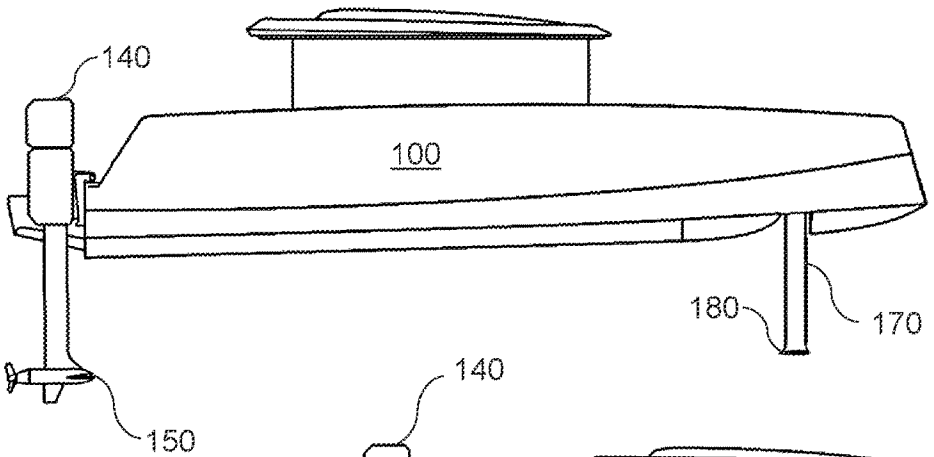
FIG. 3 is a diagram side view of the boat in hydrofoil flight mode.
Figure 4:
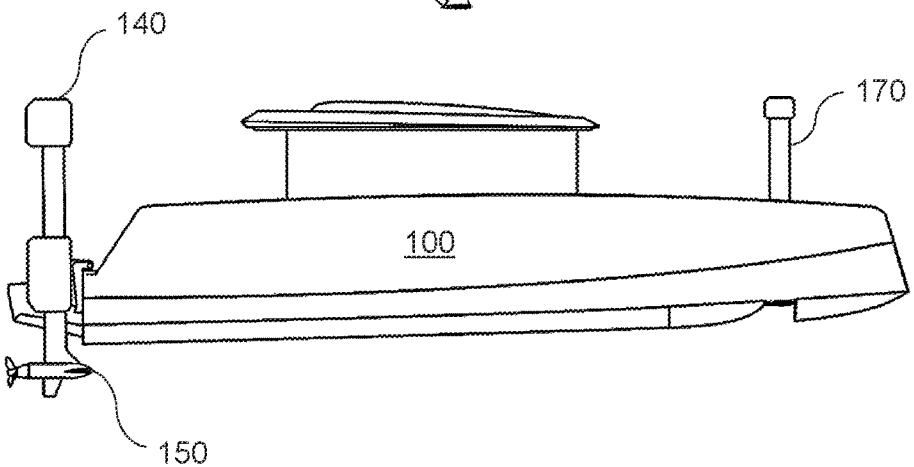
FIG. 4 is a diagram side view of the boat in displacement mode.
Figure 5:
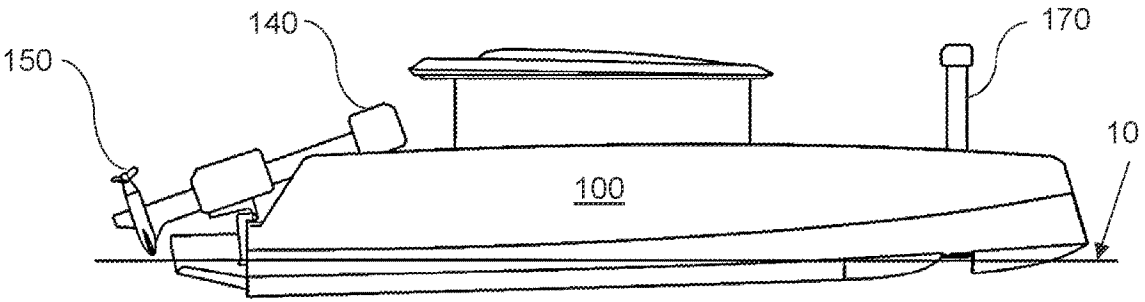
FIG. 5 is a diagram side view of the boat in docking or in a trailer transport configuration.

Together, a combination of these control features allows for sophisticated yet intuitive control of the boat of the present invention. FIGS. 3, 4, and 5 show various configurations of the boat 100 depending on the user intent and water depth available. The boat may be operated in one of two modes:

a hydrofoil flight mode (as seen in FIG. 3) when all three hydrofoils 130, 150, and 180 are deployed to their selected operational depths and the boat 100 is moving at or above the speed sufficient to lift the hull 101 above the water line, a water displacement mode (as seen in FIG. 4) at slow speed, when the front hydrofoil 180 is in the stowed position, and the rear hydrofoils 130 and 150 are deployed at a minimal depth to submerge propellers into the water—the boat 100 is operated in this case similarly to a conventional twin-outboard displacement boat.

The boat 100 may also be configured for docking and trailer transport configuration by raising the front canard hydrofoil 180 to the upper stowed position, as well as raising the rear hydrofoils 130 and 150 to the upper positions, followed by tilting them out of the water, as seen in FIG. 5 with the hydrofoils above the water line 10. In this configuration, all hydrofoils are not subject to marine growth and fouling while docking. The hydrofoils are also protected from damage by being stored closer to the hull 101 during transport, thereby addressing yet another concern of the prior art hydrofoil boats.

Figure 6:
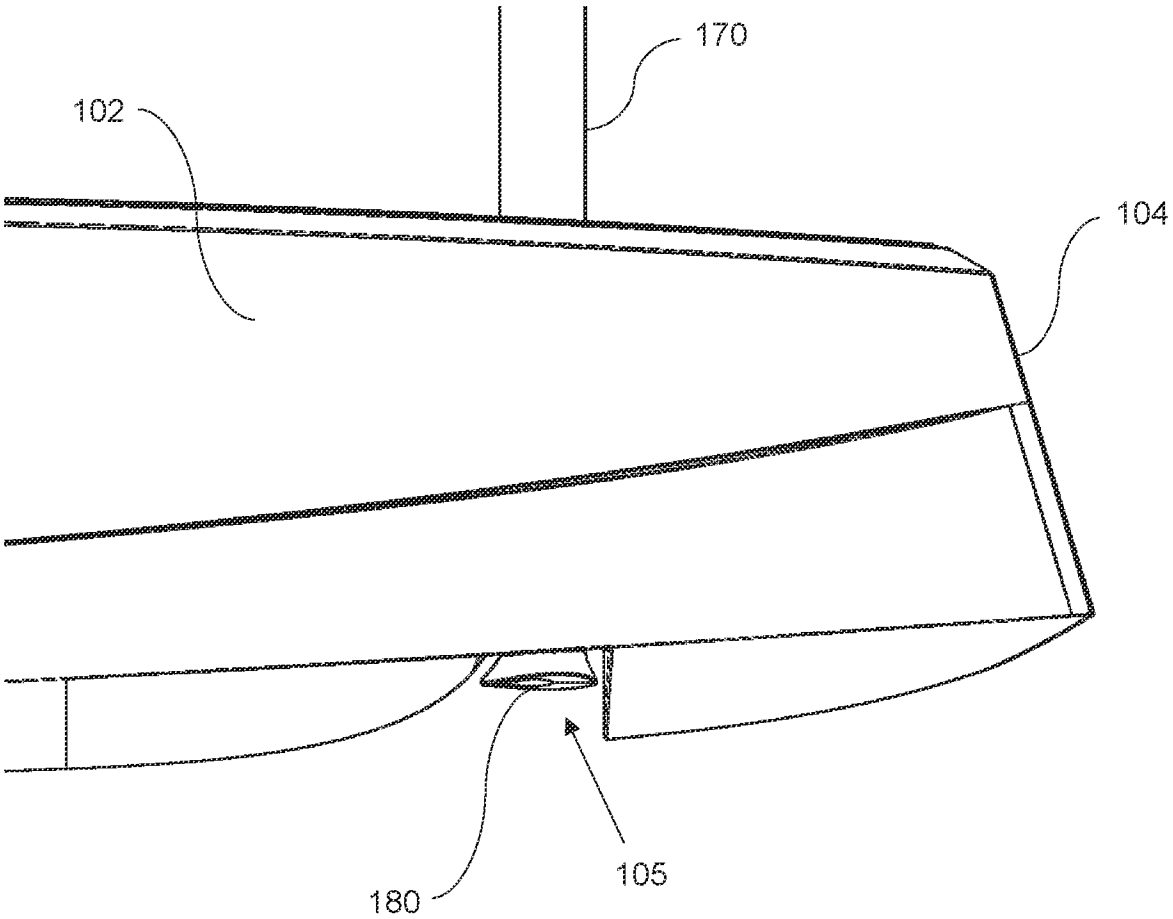
FIG. 6 is a close-up side view of the front portion of the hull with the front canard hydrofoil in the raised position.

The design for the hydrofoils and their respective support systems are now described in greater detail. FIGS. 6 through 12 illustrate various close-ups of the front portion 102 of the hull 101. FIG. 6 shows the front hydrofoil 180 in the front stowed position. An inverted bow 104 may be implemented as part of the hull 101 design. In traditional boats, the inverted bow is broadly known to aid with penetrating waves and reducing slamming loads because the buoyancy force rises sub-linearly with boat depth below the water line. Although an inverted hull feature is generally known, it is not typically used with hydrofoil boats. The present invention uses the inverted bow, which in combination with other features of the boat, helps to create additional advantages for the boat. In particular, the inverted bow 104 may be advantageous for use with the boat of the present invention for two reasons. First, when hydrofoiling a short distance above the waves, it may be preferable to slice through a large wave rather than be pushed up over it, disturbing the vessel from its altitude setpoint. Second, there may be certain situations where a hydrofoil boat can expect to experience significant slamming loads on the bow. One such situation is unintentional ventilation of the canard hydrofoil 180, where the lift on the front hydrofoil may be quickly lost, causing the bow of the boat to fall into the water. Another situation is an intentional fast landing of the boat to recover from a sudden fault condition while in a hydrofoil flight. In both cases, the presence of the inverted bow 104 may result in a more graceful return to the surface of the water, as compared to a traditional bow.

Figure 7:
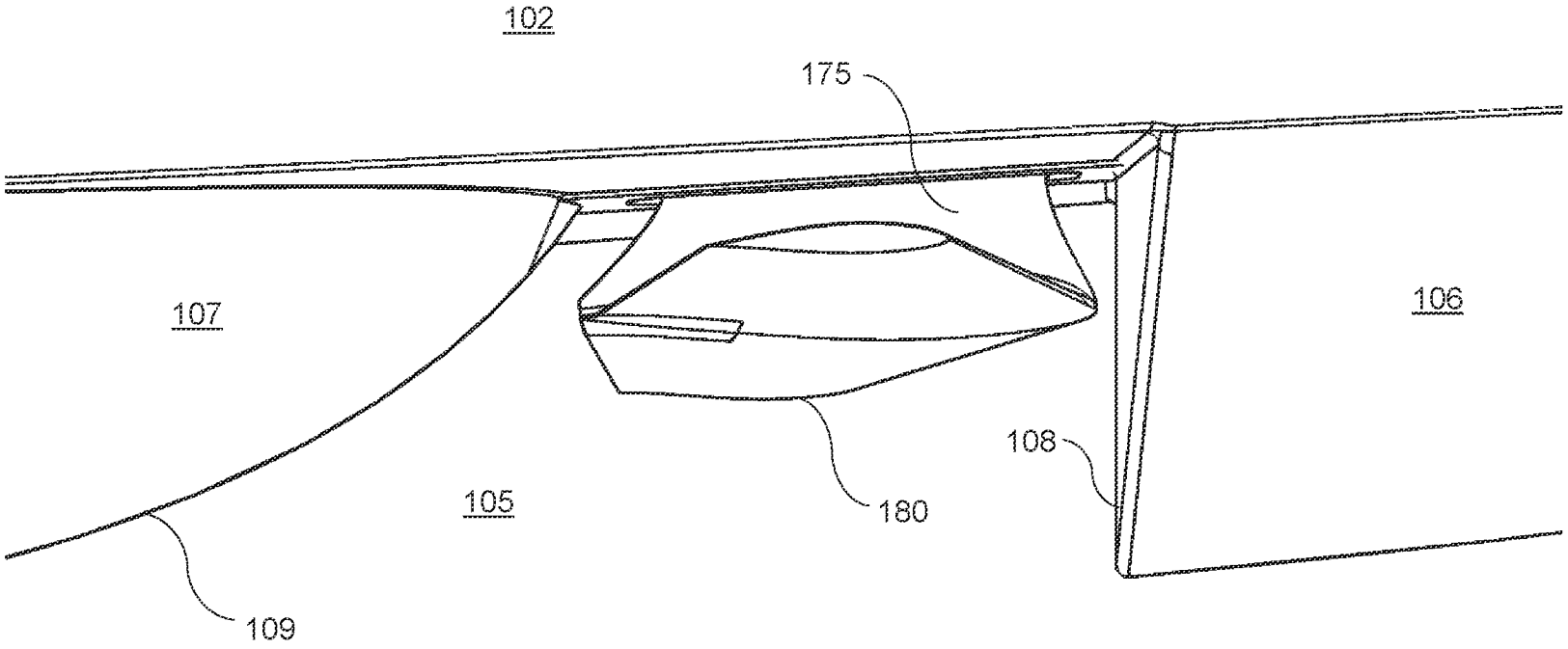
FIG. 7 is a further close-up side view of the same.
Figure 8:
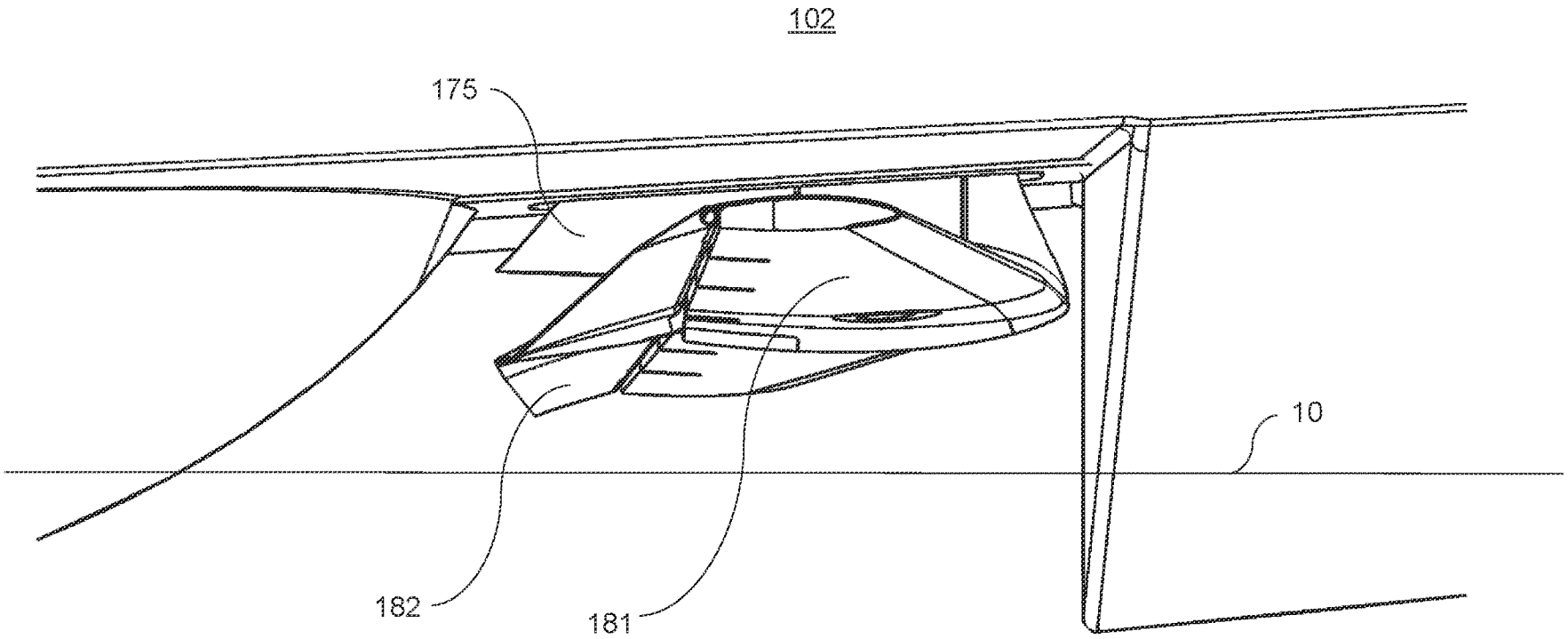
FIG. 8 is a close-up view of the same with the flap of the canard hydrofoil tilted down.

The boat 100 may feature a cut-out section 105 in the front portion 102 of the hull 101 sized to fit the front canard hydrofoil 180 within thereof. FIG. 7 shows a further close-up view of the cut-out section 105. The hull 101 may be shaped to define the cut-out section 105 between the two distinctly separate areas of the lower part of the front portion 102, a front area 106 located in front of the cut-out section 105, and the rear area 107, located adjacent to the cut-out section 105 and further behind thereof. The side view of the front canard hydrofoil 180 supported on the lower part of the front strut 175 is also seen in FIG. 7. The cut-out section 105 extends above the water line 10, as best seen in FIG. 8. Not only the cut-out section 105 may be shaped to allow the front hydrofoil 180 to be completely retracted out of the water (so it does not foul while docked), it also allows the boat to be placed on a trailer without damaging the foil. Finally, it protects the canard hydrofoil 180 from debris or the ground when driving the boat in displacement mode, especially in shallow waters.

The hull areas 106 and 107 in front and behind the cut-out section 105 may both have individually-curved, low-hydrodynamic-drag shapes because they are both exposed to the flow of water when the boat is moving. In particular, the front area 106 may have a flat vertical surface 108 (similar to the transom for a traditional boat hull) to maximize the buoyancy that this section of the hull provides and to limit the spray of water through the opening 111 in the front bearing 110 that the front strut 175 of the canard hydrofoil 180 passes through.

The rear area 107 behind the cut-out section 105 may also extend further down the hull than the front canard hydrofoil 180 in the stowed position so that the hydrofoil 180 is protected when transported on the trailer. In addition, the rear area 107 may be symmetrically shaped to gradually increase in depth behind the cut-out section 105 along profile 109, as best seen in FIGS. 7 and 11.

The front canard hydrofoil 180 may, in turn, feature at least one flap 182, which may be tilted up or down by the internal electrical actuator (not shown) positioned within the housing of the canard hydrofoil 181. FIG. 8 shows the flap 182 tilted down. The depth of the cut-out section 105 may be sufficient to keep the canard hydrofoil entirely out of the water and above the water line 10 when the flap 182 is in the down position, as seen in FIG. 8. The water line 10 is showed the configuration of the boat when it is fully loaded and, as a result, is submerged into the water at the greatest depth.

Figure 9:
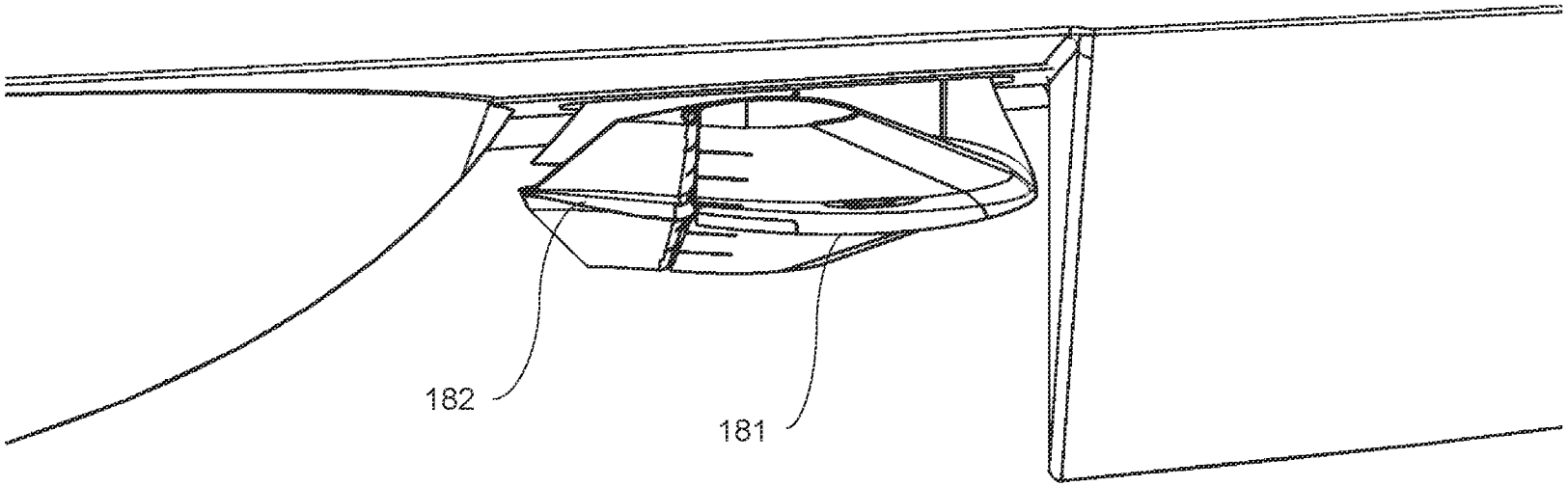
FIG. 9 is a close-up view of the same with the flap of the canard hydrofoil in a neutral position.
Figure 10:
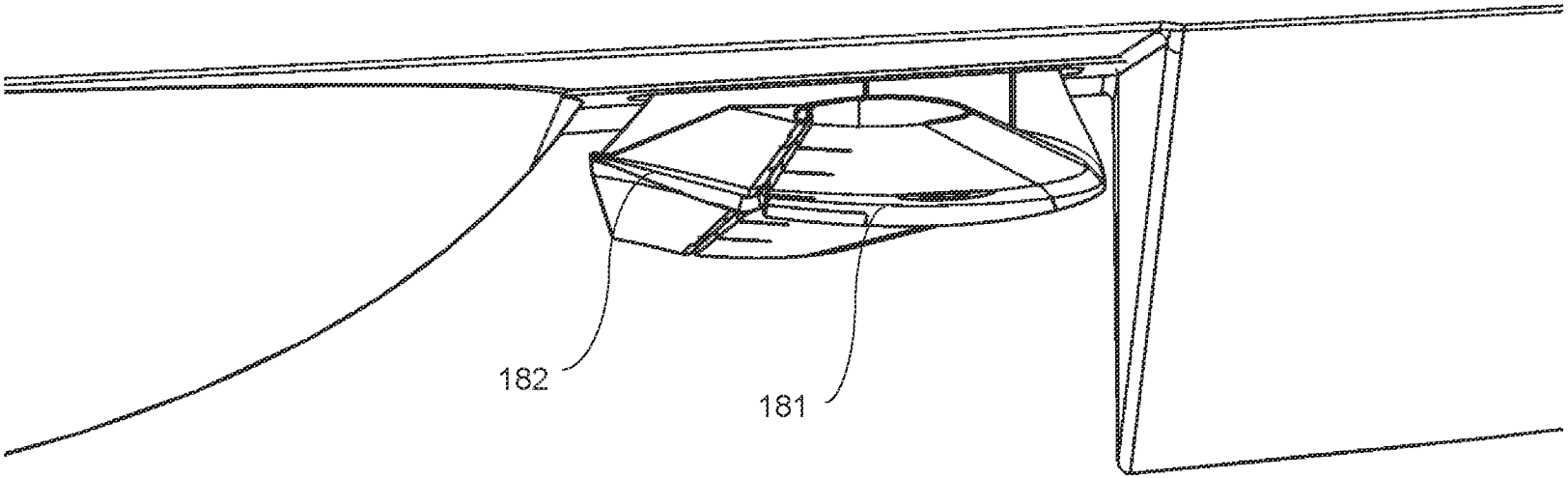
FIG. 10 is a close-up view of the same with the flap of the canard hydrofoil tilted up.

FIG. 9 shows the flap 182 in the neutral position, while FIG. 10 shows the flap 182 tilted up. The cut-out section 105 may be large enough to fit the front canard hydrofoil 180 at any position of the flap 182.

Figure 11:
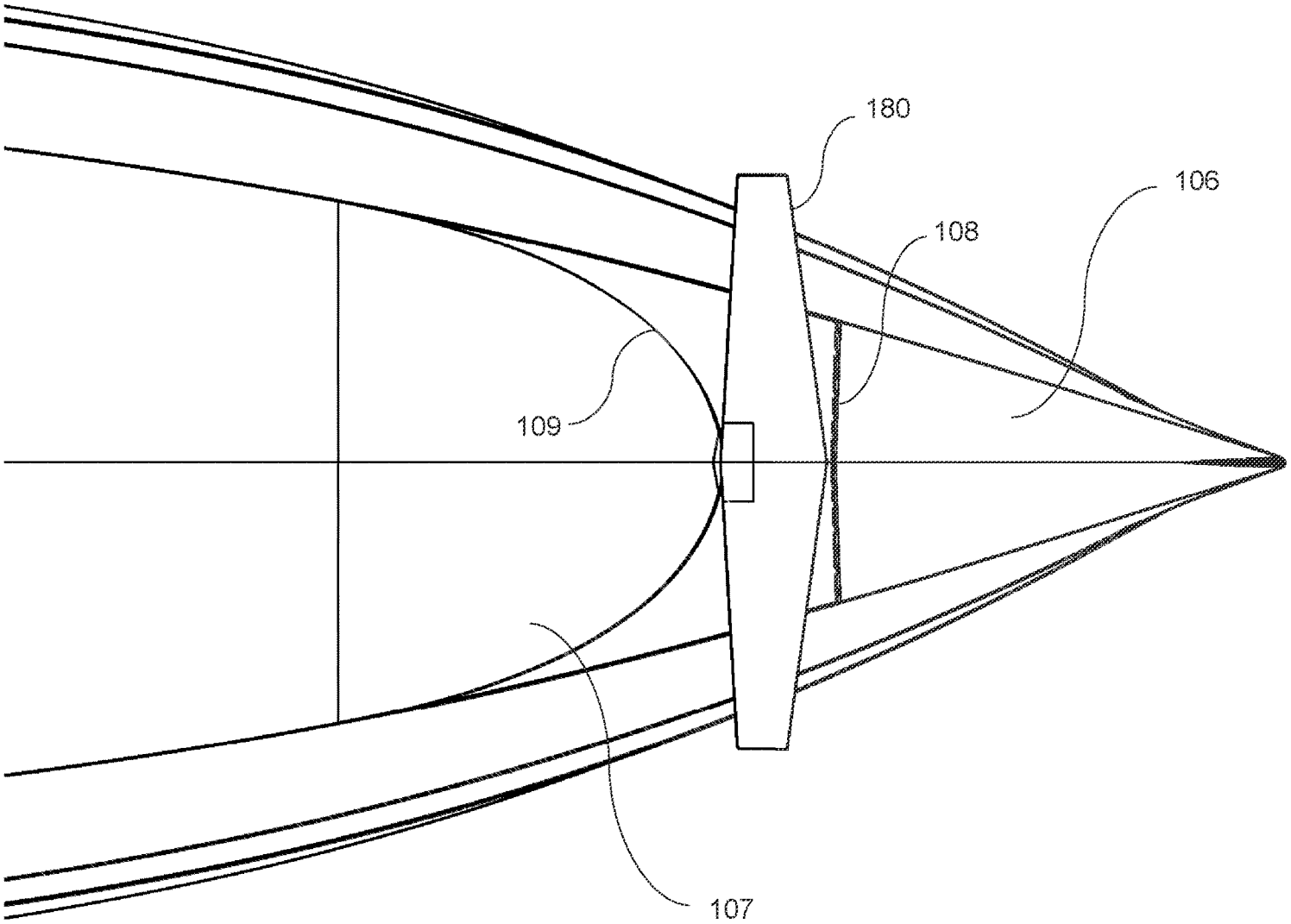
FIG. 11 is a close-up bottom view of the same.

FIG. 11 shows the close-up of the front portion 102 with a view from the bottom. The front canard hydrofoil 180 may extend laterally and away from the longitudinal axis of symmetry with sufficient width to make it visible from the top of the boat, thereby facilitating visual inspection thereof. The center of the front canard hydrofoil may still be located at or along the longitudinal axis of symmetry of the boat 100.

The front strut 175 supporting the front canard hydrofoil 180 may be arranged to pass through the opening 111 of the front bearing 110 in the hull 101 and extend vertically to the front support system 170. The front support system 170, in turn, may be configured to allow the strut 175 to be moved up or down as desired to select the suitable depth for the front canard hydrofoil 180. Various mechanical or electro-mechanical systems may be used to facilitate manually-operated or mechanized action of lifting and lowering the strut 175. In one example (not shown), an electric motor may be operably connected via a gearbox to a rack and pinion arrangement to cause the strut 175 to move up and down (similarly to the design of the rear support system described in greater detail below). In other examples, a suitable winch or manually-operated gearbox system may be deployed for that purpose, as the invention is not limited in this regard.

Figure 12:
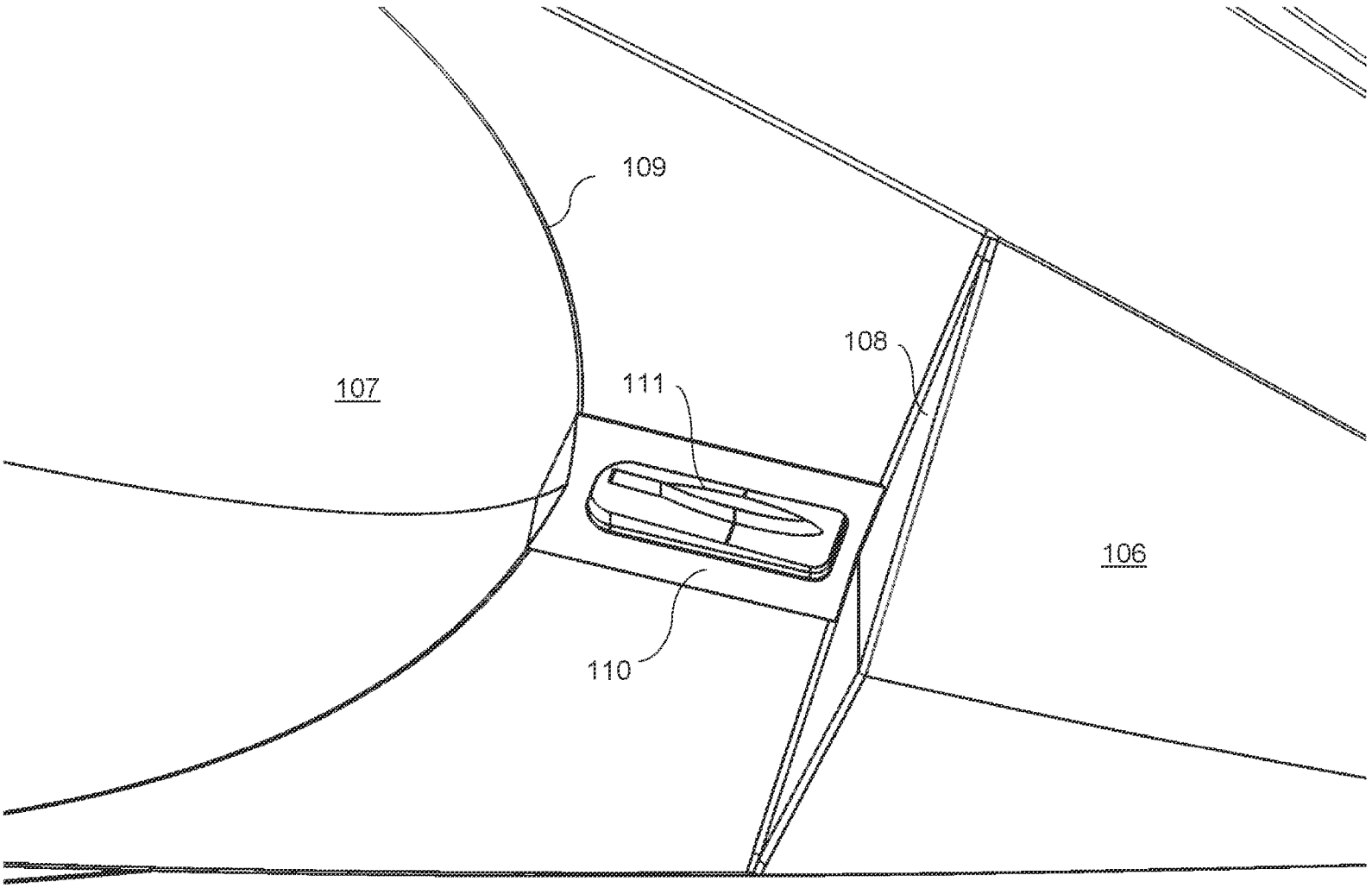
FIG. 12 is a close-up perspective view of the same with the front canard hydrofoil removed for clarity.

FIG. 12 shows a detail of the cut-out section 105 with the front canard hydrofoil 180 removed—for better clarity of the position of the front bearing 110 having the elongated opening 111 matching the shape of the strut 175. The strut 175 may be made with an elongated cross-section oriented along the hull 101 of the boat 100, so as to provide better stability for the boat while in a hydrofoil flight mode.

Figure 13:
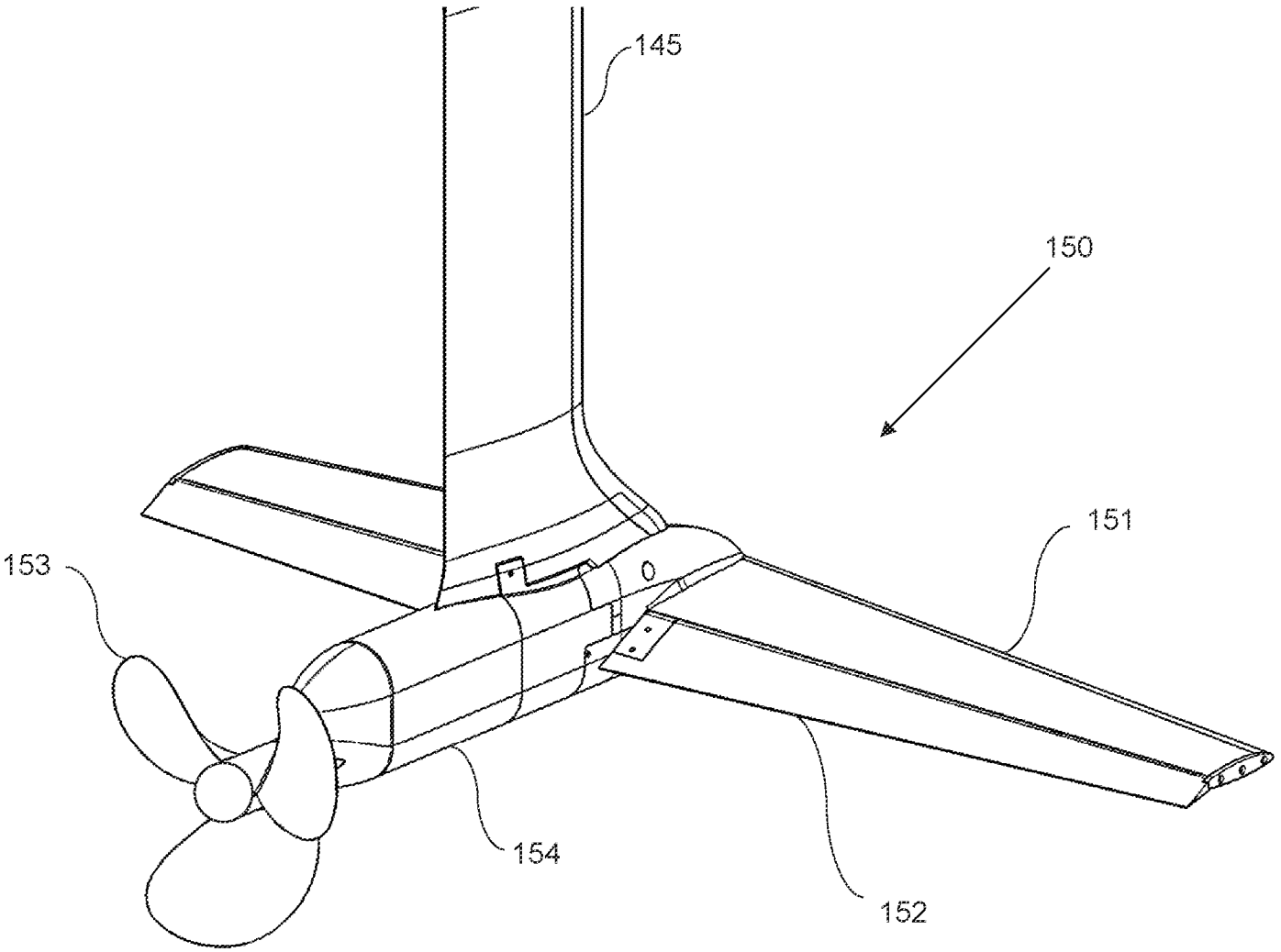
FIG. 13 is a close-up perspective view of the rear hydrofoil.

FIG. 13 shows a close-up perspective view of the rear hydrofoil 150, which has the same design as the rear hydrofoil 130 and may be attached at the bottom of the rear strut 145. Together, both rear hydrofoils 130 and 150 may operate as a single main wing of the hydrofoil boat 100.

As the front strut 175, the rear strut 145 (as well as the rear strut 125) may have an elongated hydro-dynamically designed cross-section. The long axis of this cross-section may be aligned with the direction of the thrust vector of the corresponding propeller 153 being driven by a respective motor. Rotating the respective first and second hydrofoils 130 and 150 around their respective first and second vertical axes causes the first and second rear struts 125 and 145 to operate as rudders of the hydrofoil boat 100, which may be useful for steering purposes.

In the example shown in FIG. 13, an electric motor may be located inside an enlarged portion of the housing 154 behind the propeller 153. The housing 154 may also be hydro-dynamically shaped to minimize resistance when moving through the water. The rear hydrofoil 150 may further have a suitable shaped lateral housing 151 with one or more flaps 152 located along the length thereof. Flaps 152 may be operated to be tilted up or down by internal electric actuators located in the housing 154 or the housing 151. FIG. 13 shows an example of the flaps tilted down, as the invention is not limited in this regard.

Figure 14:
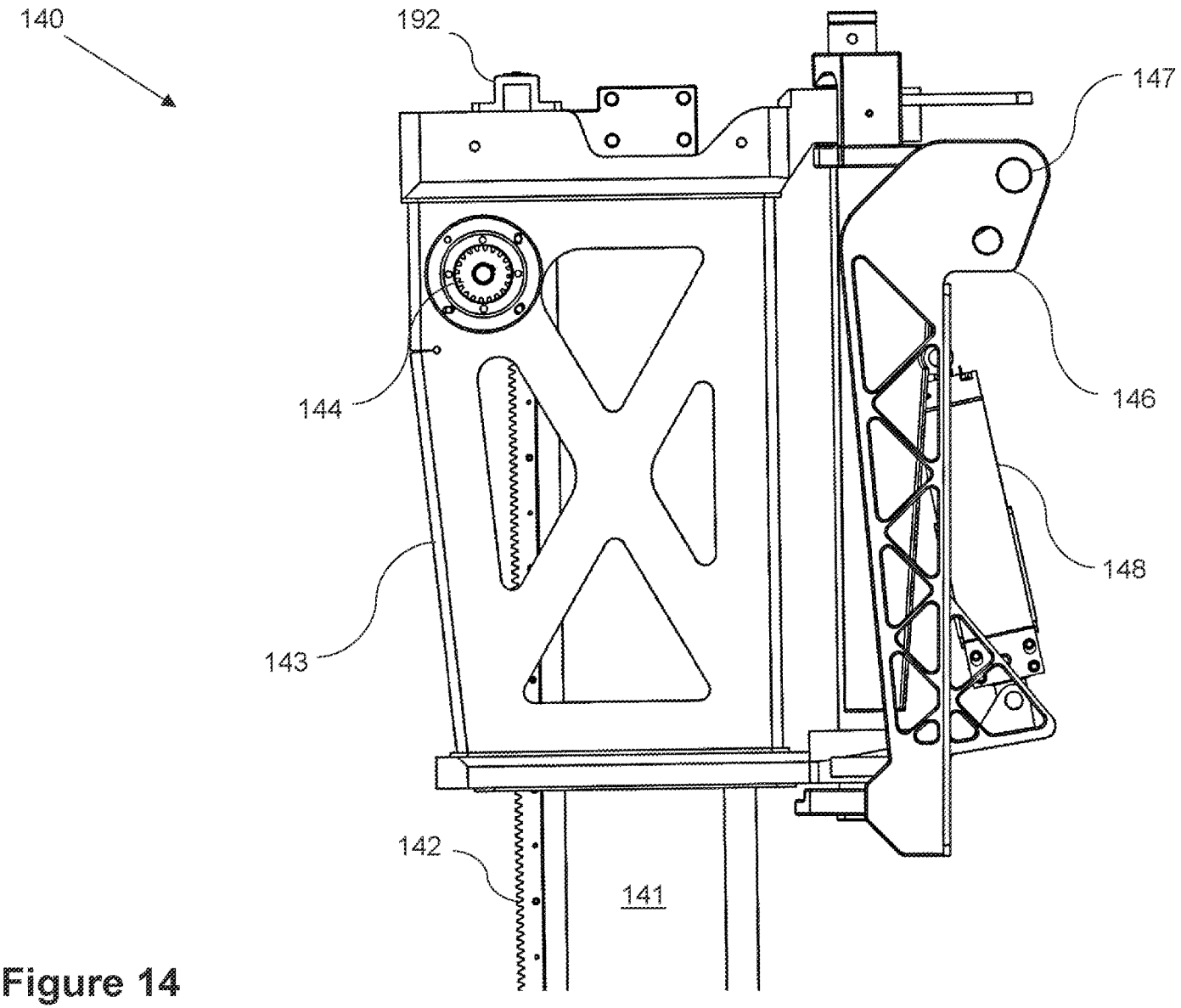
FIG. 14 is a close-up side view of the components of the rear support system in the down and locked position.
Figure 15:
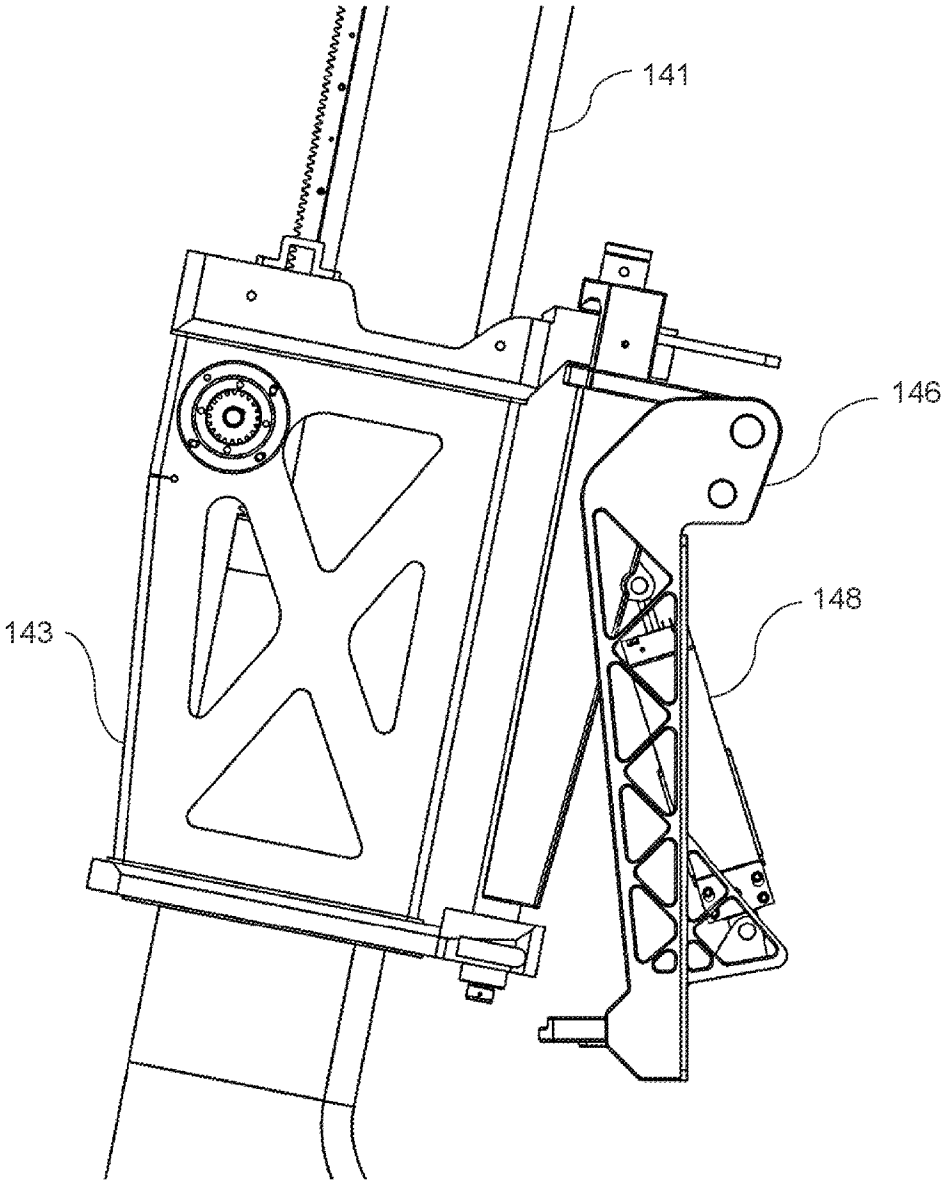
FIG. 15 is the same in a lifted and partially tilted position.

Details of the upper portion of the rear support system 140 are seen in FIGS. 14 and 15. To facilitate the lifting of the upper portion 141 of the rear strut 145, a rack gear arrangement may be made on the strut 141, with the corresponding pinion gear 144 rotatably mounted on the main bracket 143. An electric motor may be used to turn the pinion gear 144 via a suitable gearbox (not shown in FIG. 14 for clarity). A lock bar channel 192 may be attached to the top of the main bracket 143 and configured for the insertion of a lock bar (not shown). When positioned in the lock bar channel 192, the lock bar may be located directly above the rear strut 145. When present, it prevents the rear strut 145 from moving up the main bracket 143, thereby locking the rear hydrofoil 150 in place and relieving a constant load on the rack-and-pinion system from the weight of the boat when in a hydrofoil flight mode or operation.

The main bracket 143 is pivotally attached to the transom bracket 146, which, in turn, is affixed to the hull 101 of the boat 100. The main bracket 143 may therefore tilt around the axis of rotation 147 when the rear hydrofoil 150 needs to be stowed away and out of the water.

To facilitate the tilting process, a hydraulic cylinder 148 or another suitable linear actuator may be used. Initially, the cylinder 148 may be in the retracted position, as seen in FIG. 14. An optional locking pin may be used to prevent it from moving. When the pin is removed, and the cylinder s elongated, it may cause the main bracket 143 to tilt about the axis of rotation 147, as best seen in FIG. 15. Further extension of the cylinder 148 may be used to cause the completion of the tilting operation to lift the rear hydrofoil 150 out of the water. To secure the rear support system in the tilted position, a guard rail in the back of the rear support system 140 may have an opening 149 (see FIG. 1), such that the upper portion of the rear strut 141 may fit inside thereof to facilitate additional fixation and securing the rear support position in place. This may be done during transport of the boat on a trailer, or during storing the boat out of the water for other purposes.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain, using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. AH publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C. AB, AC, BC, or ABC, and if order is important in a particular context, also BA, CA, CB, CBA, BCA, RCB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A hydrofoil boat comprising:

an elongated hull defining a front portion and a rear portion, wherein the improvement is characterized by the hydrofoil boat further comprising:

a front canard hydrofoil mounted on a front support system positioned in the front portion of the hull and configured to raise or lower the front canard hydrofoil between a front stowed position and a front operating position, a pair of independently-controlled first rear hydrofoil and second rear hydrofoil, each of the first and second rear hydrofoils mounted on a respective first rear support system and a second rear support system in the rear portion of the hull, each of the first and the second rear hydrofoils is equipped with a respective and independently-controlled first and second motor-driven propeller, wherein each of the first and the second rear support systems is further configured to:

independently raise or lower the respective first and second rear hydrofoils between a raised position and a lowered position, independently rotate the respective first and second rear hydrofoils around their respective first and second vertical axes to facilitate steering of the hydrofoil boat, and independently tilt the respective first and second rear hydrofoils out of the water when the first and the second rear hydrofoils are in the raised position.

2. The hydrofoil boat, as in claim 1, wherein the elongated hull defines a longitudinal axis of symmetry along a length thereof, and wherein a center of the front canard hydrofoil is located along the longitudinal axis of symmetry thereof.

3. The hydrofoil boat, as in claim 2, wherein the pair of first and second rear hydrofoils is located side-by-side in the rear portion of the hull and symmetrically along the longitudinal axis of the hull.

4. The hydrofoil boat, as in claim 3, wherein the pair of first and second rear hydrofoils is located adjacent to each other and configured to operate together as a single main wing of the hydrofoil boat.

5. The hydrofoil boat, as in claim 1, wherein the first and the second motor-driven propellers are rotated using battery-operated electric motors, thereby the hydrofoil boat is entirely electrically operated.

6. The hydrofoil boat, as in claim 1, wherein the first and the second rear support systems respectively comprise a first rear strut and a second rear strut, configured to support respectively the first rear hydrofoil and the second rear hydrofoil.

7. The hydrofoil boat, as in claim 6, wherein each of the first rear strut and the second rear strut has an elongated cross-sectional shape aligned with the respective thrust vectors of the first and second motor-driven propellers, thereby rotating the respective first and second rear hydrofoils around their respective first and second vertical axes causes the first and second rear struts to operate as rudders of the hydrofoil boat for steering purposes thereof.

8. The hydrofoil boat, as in claim 1, wherein the hull has a cut-out section on a bottom thereof sized and configured to fit the front canard hydrofoil therein when in the front stowed position.

9. The hydrofoil boat, as in claim 8, wherein the cut-out section extends above a water line of the hydrofoil boat.

10. The hydrofoil boat, as in claim 9, wherein the cut-out section is sized to accept the front canard hydrofoil to be out of the water when in the front stowed position, thereby all of the front and rear hydrofoils of the hydrofoil boat have at least one position out of the water.

11. The hydrofoil boat, as in claim 1, wherein the front canard hydrofoil is equipped with a flap configured to be tilted up or down to control the operation of the hydrofoil boat.

12. The hydrofoil boat, as in claim 11, wherein the cut-out section is sized to accept the front canard hydrofoil to be out of the water when in the front stowed position regardless of whether the front flap is tilted up or down.

13. The hydrofoil boat, as in claim 9, wherein a hull bottom area adjacent the cut-out section is curved to minimize hydrodynamic drag caused by the cut-out section of the hull.

14. The hydrofoil boat, as in claim 13, wherein the hull bottom area adjacent the cut-out section of the hull extends lower than the front canard hydrofoil when in the front stowed position, thereby protecting the front canard hydrofoil from debris or a bottom ground when operating in shallow water.

15. The hydrofoil boat, as in claim 1, wherein the hull has an inverted bow in the front portion thereof.

16. The hydrofoil boat, as in claim 1, wherein each of the first and the second rear support systems are respectively rotatably supported at the rear portion of the elongated hull to facilitate independent tilting of the first and the second rear support systems while in the raised position, thereby raising respective first and second rear hydrofoils out of the water.

17. A hydrofoil boat comprising:

an elongated hull defining a front portion and a rear portion, wherein the improvement is characterized by the hydrofoil boat further comprising:

a front canard hydrofoil mounted on a front support system positioned in the front portion of the hull and configured to raise or lower the front canard hydrofoil between a front stowed position and a front operating position, a pair of independently-controlled first rear hydrofoil and second rear hydrofoil, each of the first and second rear hydrofoils mounted on a respective first rear support system and a second rear support system in the rear portion of the hull, each of the first and the second rear hydrofoils is equipped with a respective and independently-controlled first and second motor-driven propeller, wherein each of the first and the second rear support systems is further configured to:

independently raise or lower the respective first and second rear hydrofoils between a raised position and a lowered position, and independently rotate the respective first and second rear hydrofoils around their respective first and second vertical axes to facilitate steering of the hydrofoil boat, and wherein each of the first and the second rear support systems are respectively rotatably supported at the rear portion of the elongated hull to facilitate independent tilting of the first and the second rear support systems while in the raised position, thereby raising respective first and second rear hydrofoils out of the water.

* * * * *